United States Patent [19]

van der Wolfe et al.

[11] 3,984,589

[45] Oct. 5, 1976

[54] METHOD OF MANUFACTURING A LOW PRESSURE MERCURY VAPOR DISCHARGE LAMP

[75] Inventors: Rein Willemse van der Wolfe; Thomas Hendrik de Vette, both of Eindhoven, Netherlands

[73] Assignee: U.S. Philips Corporation, New York, N.Y.

[22] Filed: Oct. 21, 1974

[21] Appl. No.: 516,633

Related U.S. Application Data

[62] Division of Ser. No. 412,606, Nov. 5, 1973, Pat. No. 3,875,454.

[30] Foreign Application Priority Data

Nov. 25, 1972 Netherlands ..... 7216025

[52] U.S. Cl. ..... 427/106; 427/126; 427/226

[51] Int. Cl.[2] ..... B05D 7/22; H01J 1/70

[58] Field of Search ..... 427/106, 108, 126, 226

[56] References Cited

UNITED STATES PATENTS

| | | | |
|---|---|---|---|
| 3,141,990 | 7/1964 | Ray | 427/106 X |
| 3,647,531 | 3/1972 | Matsushita et al. | 427/108 |
| 3,676,729 | 7/1972 | Menelly | 427/106 X |
| 3,713,884 | 1/1973 | Maley | 427/106 X |
| 3,853,612 | 12/1974 | Spanoudis | 427/106 |

*Primary Examiner*—Ralph Husack
*Attorney, Agent, or Firm*—Frank R. Trifari

[57] ABSTRACT

In a low-pressure mercury vapor discharge lamp a method of applying a tin oxide coating to the inside wall of the lamp having a resistance per square of more than 10,000 Ohm to avoid blackening of the glass. This coating may be used in the aperture of a lamp for photo-copying purposes.

3 Claims, 1 Drawing Figure

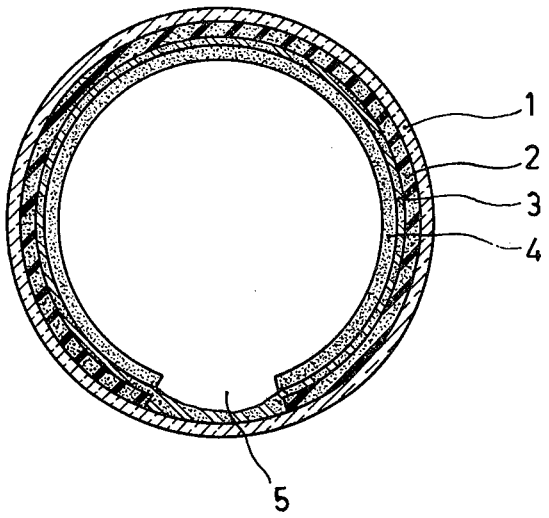
1
2
3
4
5

METHOD OF MANUFACTURING A LOW PRESSURE MERCURY VAPOR DISCHARGE LAMP

This is a division of application Ser. No. 412,606, filed Nov. 5, 1973, now U.S. Pat. No. 3,875,454.

In low-pressure mercury vapour discharge lamps in which the energy in the gas discharge is converted into radiation, particularly into light the phenomenon often occurs that the glass wall gets a grey appearance after a number of operating hours. This grey discoloration which is caused by an interaction of mercury and the glass wall results in radiation absorption and an unesthetic appearance of the lamp.

The number of operating hours after which the radiation absorption becomes inadmissible due to the grey discoloration and the lamp thus has to be replaced is firstly dependent on the current density in the lamp, i.e. the number of mA/sq.cm of the cross-section of the discharge space. Furthermore, as regards the grey discoloration, it is a great difference whether the wall of the lamp is bare or is coated with a luminescent coating. In a bare lamp having a bare wall the grey discoloration, both at high and at low current densities, i.e. above and below a value of 50 mA/sq.cm is already inadmissible after a number of operating hours which in lamps having a luminescent coating on the wall does not result in a disturbing grey discoloration. At a low current density the grey discoloration in lamps having a luminescent coating on the inner side of the glass wall of the lamp is often so little that no special steps are necessary.

In a given type of lamp having a luminescent coating (furthermore denoted by S-lamp) an apertured part of the glass wall extending longitudinally is not coated with a luminescent material. In such lamps which are particularly used for photo-copying equipment the glass in the aperture is directly exposed to the mercury discharge and a very strong grey discoloration occurs after a very short time at that area especially when the current density in the discharge is chosen to be high so as to obtain an intensive radiation.

To inhibit the grey discoloration it has already been proposed to coat the glass with a transparent protective coating of a metal oxide namely titanium dioxide. This titanium dioxide coating is always formed in practice from a solution of tetrabutyltitanate. In S-lamps the glass in the aperture must then be coated in any case with such a protective coating. Often, however, the entire glass wall is coated prior to the luminescent coating being provided because this is simpler than providing the protective coating alone in the aperture with the aid of special equipment.

A low-pressure mercury vapour discharge lamp according to the invention, having a glass envelope whose inner side has a luminescent coating and a transparent metal oxide coating located between this coating and the wall is characterized in that the metal oxide coating consists of tin oxide and has a resistance per square of at least 10,000 Ohm.

In this connection resistance per square of the tin oxide coating is understood to mean the resistance measured between two strip-shaped parallel electrodes of 1 cm length pressed on the tin oxide coating and being spaced 1 cm apart.

The resistance per square of the tin oxide coating must be higher than 10,000 Ohm because otherwise the protective coating is conducting in such a manner that it detrimentally interferes with the gas discharge so that black spots and specks are produced after a given number of operating hours.

Likewise as the above-mentioned known protective coating consisting of titanium dioxide the tin oxide coating is very satisfactorily transparent and quite scratch resistant. The tin oxide can also easily be provided during a bulk manufacturing process.

The invention is of special importance for those kinds of lamps (furthermore denoted by F-lamps) in which the lamp wall not only has a luminescent coating but also a reflective coating. Such a reflective coating serves to concentrate the light generated in the luminescent coating in a given direction. To this end the reflective coating is present between the glass wall and the luminescent coating but it is not provided over the entire circumference of the glass envelope. Two different types of lamps can be distinguished in this respect, namely those in which the luminescent coating extends over the entire circumference and those in which the luminescent coating and hence the reflective coating leave a apertured part of the glass wall uncoated. Lamps of the latter type (further denoted by FS-lamps) are thus the same as the S-lamps described above, but have a reflective coating between the luminescent coating and the glass wall. The reflective coating and the luminescent coating may extend or not extend over the same circumferential angle. Granular titanium dioxide is commonly used as a material for the reflective coating.

Both in F-lamps and in FS-lamps it is possible to provide the known protective coating of titanium dioxide or the tin oxide coating according to the invention as a first coating on the glass wall likewise as in lamps without a reflective coating, and to subsequently provide the reflective coating on the protective coating and finally provide the luminescent coating. To adhere the coatings to the wall or to a previously provided coating a separate heat treatment, the so-called sintering treatment, is always necessary in order to remove the solvent and binder used for the formation of the coating. Thus the lamp is to be placed three times in a furnace, heated, cooled and removed. These operations make the manufacture of such types of lamps time-consuming and expensive.

Departing from the above-described manufacture the reflective coating may alternatively be firstly provided on the wall, followed by the protective coating and the luminescent coating. It is true that a slightly better adhesion of the reflective coating is then obtained, but when using a protective coating of titanium dioxide three times sintering remains necessary. In addition a large quantity of titanium dioxide is required to form the protective coating because the sintered reflective coating is very porous.

Unlike a protective coating of titanium dioxide, a protective coating of tin oxide according to the invention may be formed in situ from a suitable organic tin compound such as, for example, dibutyltinmaleate on a reflective coating which has not been previously sintered. Thus one of the three sintering operations is then omitted. Moreover, less material is used for the protective coating because this coating in case of a suitable solvent being chosen is directly provided on the reflective coating which still comprises binder and is thus not porous for the organic tin compound.

When using the method described in the previous paragraph, lamps are obtained in which the tin oxide is directly supported by the glass wall at those areas where there is no reflective coating and is located between the reflective coating and the luminescent coating in the other part of the lamp.

The tin oxide coating of a suitably chosen organic tin compound such as, for example, dibutyltinmaleate may of course alternatively be provided in situ in lamps in which the protective tin oxide coating is directly supported by the glass wall over the entire circumference of the lamp.

Further advantages of the use of organic tin compounds over tetrabutyltitanate are that the solution of the tin compounds from which tin oxide can be formed in situ does not foam, does not hydrolize and does not form a gel. Also the rate of coating of the lamps may be much faster than when using titanium dioxide particularly because foaming does not occur.

The invention will now be described in greater detail with reference to a drawing of an FS-lamp and a description of an example of its manufacture.

The drawing shows in a cross-sectional view an FS-lamp in which the protective coating of tin oxide in the aperture is supported by the glass wall and is furthermore located between the reflective coating and the luminescent coating. In this FIGURE, 1 is the glass wall, 2 is the reflective coating, for example, of titanium dioxide, 3 is the tin oxide coating having a resistance per square of more than 10,000 Ohm and 4 is the luminescent coating, for example, of willemite. The drawing clearly shows that in the aperture which is denoted by 5 the glass wall 1 is only coated with the protective tin oxide coating 4. There is no reflective coating and no luminescent coating in the aperture.

In the manufacture of a lamp as shown in the drawing the glass tube 1 is brought to a vertical position before the stems with the electrodes and the exhaust tube are provided and is coated with the desired reflective coating by injection or raising a titanium dioxide suspension. The suspension used for this purpose is prepared by suspending 800 gms of granular $TiO_2$ in 400 ml of butylacetate to which 25 ml of dibutylphthalate have been added. After this suspension has been ground for 7 hours in a ball mill, 280 ml of a 1 percent solution of nitrocellulose in butylacetate is added and grinding takes place for another hour.

After the $TiO_2$-coating is provided it is dried with the aid of hot air of 18°–25°C for approximately 10 minutes and butylacetate evaporates but nitrocellulose and dibutylphthalate remain. Subsequently a strip-shaped part of the $TiO_2$ coating is wiped off over the entire tube length with the aid of a vulcalon plate.

The partly coated tube wall thus obtained is then coated, by means of injection or raising in the tube, with a thin coating of a solution having the following composition:

750 ml ethanol
250 ml isobutanol
1% by volume of ethylcellulose
½% by volume of dibutyltinmaleate.

At this manufacturing stage the tin coating of the solution adheres both to the $TiO_2$ coating and to the glass in the wiped-out aperture. The binder of the $TiO_2$ coating does not dissolve in this solution and the $TiO_2$ coating thus remains intact.

After drying at room temperature for approximately 2 minutes the tube having the two coatings is introduced into a furnace and heated for 50 to 150 seconds at a temperature of approximately 580°C. Dibutylphthalate, nitrocellulose and ethylcellulose thereby evaporate and burn out and dibutyltinmaleate is converted into a tin oxide layer having a resistance per square of at least 10,000 Ohm.

After the tube has been removed from the furnace and has cooled, the luminescent coating is provided by injecting or raising a suspension of willemite in the vertically placed tube. The suspension used for this purpose is manufactured by grinding 100 gms of willemite for 2 hours in a ball mill in 400 mls of a 1% solution of nitrocellulose in a mixture of 95% butylacetate and 5% monoethylglycolether to which ½% by volume of dibutylphthalate, 2 gms of $Sb_2O_3$ and 6 gms of $Sr_2P_2O_7$ have been added. After drying (at 20° – 25°C for approximately 10 minutes) of the suspension coating thus provided an aperture is wiped out with the aid of a vulcalon plate in the dried suspension coating at the same area where the aperture has been wiped out of the $TiO_2$ coating. Subsequently the tube is again introduced into a furnace and heated for 50 to 150 seconds at approximately 530°C during which nitrocellulose completely evaporated and burns out.

The tube having three coatings obtained after this operation is finished in known manner to a fluorescent lamp particularly intended for photo-copying purposes by providing steps with electrodes, exhausting, filling, operating etc.

What is claimed is:

1. A method of coating the inner side of the glass envelope of a low-pressure mercury vapour discharge lamp which comprises: forming on the inside surface of said envelope a tin oxide coating having a resistance greater than 10,000 ohms per square in situ from an organic tin compound.

2. A method as claimed in claim 1, which comprises applying to the inner surface of said glass envelope a non-sintered, binder-containing light reflective coating before forming said tin oxide coating.

3. A method as claimed in claim 1, characterized in that the organic tin compound consists of dibutyltinmaleate.

* * * * *